United States Patent [19]

Helm et al.

[11] Patent Number: 5,019,030

[45] Date of Patent: May 28, 1991

[54] ENVELOPE BLANK FORMING MACHINE

[75] Inventors: Herbert W. Helm, Hollidaysburg; John R. Anderson, Duncansville; Michael P. Lambert, Altoona, all of Pa.

[73] Assignee: F. L. Smithe Machine Company, Inc., Duncansville, Pa.

[21] Appl. No.: 515,173

[22] Filed: Apr. 26, 1990

[51] Int. Cl.[5] ..... B31B 23/14; B31B 41/14

[52] U.S. Cl. ..... 493/342; 493/229; 493/232; 493/237; 493/239

[58] Field of Search ..... 226/179, 180, 197; 493/227, 237, 239, 229, 230, 232, 235, 72, 81, 342

[56] References Cited

U.S. PATENT DOCUMENTS

| | | | |
|---|---|---|---|
| 2,694,351 | 11/1954 | Winkler et al. | 493/229 |
| 2,951,408 | 9/1960 | Novick | 83/88 |
| 2,991,679 | 7/1961 | Moran | 226/197 |
| 3,954,213 | 5/1976 | Andersen | 226/97 |

FOREIGN PATENT DOCUMENTS

| | | | |
|---|---|---|---|
| 0538848 | 6/1955 | Belgium | 493/232 |
| 0751989 | 7/1956 | United Kingdom | 493/232 |

*Primary Examiner*—Frederick A. Schmidt
*Assistant Examiner*—John A. Marlott
*Attorney, Agent, or Firm*—Stanley J. Price, Jr.

[57] ABSTRACT

An envelope blank forming machine for forming generally rectangular booklet envelope blanks and generally diagonal envelope blanks on the same machine includes a pair of removable turnbars, adjustable pull rolls and an adjustable cutoff device. Preselected adjustment of these components provides a generally rectangular blank or a generally diagonally shaped blank. Retractable trim devices are provided in cutting relation with the blank when diagonal blanks are being formed. Seal flap cutters and first and second flap cutters are provided to form the booklet seal flap and bottom flap on the booklet envelope blank. These cutters are removed and replaced with seal flap corner cutters, bottom flap corner cutters and diagonal trim cutters when generally diagonal envelope blanks are being formed.

2 Claims, 1 Drawing Sheet

ENVELOPE BLANK FORMING MACHINE

BACKGROUND OF THE INVENTION

1. Field Of The Invention

This invention relates to an envelope blank forming machine and more particularly to an envelope blank forming machine for making either generally rectangular booklet type envelope blanks or generally diagonal type envelope blanks.

2. Description Of The Prior Art

Machines for making booklet type envelope blanks are known. Other machines for making diagonal envelope blanks are also known. Web attachments for open end blanks as well as booklet blanks are also known.

U.S. Pat. No. 3,954,213 discloses a turnbar apparatus for turning a strip from a web from a horizontal plane to a vertical plane to adjust the entry angle of the strip as it is fed into the blank forming machine. The turnbars are mounted on separate supports and are adjustable relative to each other.

U.S. Pat. No. 2,951,408 discloses apparatus for forming only diamond or diagonal envelope blanks from a strip where the strip is fed to the machine at an angle to the axis of the blank forming machine. A means to adjust the angular relationship of the cutting knives and the shape of the diamond or diagonal blanks is also disclosed. The apparatus of conveying, shaping, driving, supporting and adjusting various components of the machine disclosed in U.S. Pat. No. 2,951,408 is incorporated herein by reference.

There is a need to provide an envelope blank forming machine that uses some of the same components for forming either generally rectangular booklet envelope blanks or generally diagonal envelope blanks. There is also a need to provide means to retract certain components when not required to form a particular envelope blank and to further substitute certain components in the same stations for the production of envelope blanks of a particular configuration.

SUMMARY OF THE INVENTION

This invention relates to an envelope blank forming machine to form either generally rectangular booklet envelope blanks or generally diagonal envelope blanks from a web and includes pull rolls arranged on the machine to pull the strip of paper from the web and feed the strip into the envelope blank forming machine. The pull rolls are positioned in a perpendicular position relative to the axis of the machine to feed the strip axially into the machine when forming booklet envelope blanks. The pull rolls are movable to an angular position relative to the axis of the machine to feed the strip at an angle to the axis of the machine for forming diagonal blanks. A rotatable cutoff knife is positioned in a perpendicular position relative to the axis of the machine and perpendicular to the strip to cut off booklet envelope blanks from the strip having a generally rectangular configuration. The rotatable cutoff knife is movable to an angular position relative to the axis of the machine and the strip to cut the strip diagonally to the strip axis to form a blank having a diagonal configuration. A first removable turnbar is positioned upstream of the pull rolls and is arranged at an angle to the axis of the blank forming machine. The turnbar is arranged to angularly change the direction of the strip from a direction aligned with the axis of the machine to an angular direction. The first turnbar is removed from the machine during the forming of booklet envelope blanks. A second removable turnbar is positioned in spaced relation to the first turnbar and is arranged at an angle to the axis of the blank forming machine. The second turnbar is arranged to control the direction of movement of the strip to the pull rolls so that the strip moves at an angle to the axis of the machine. The second turnbar is removed from the machine during the forming of booklet envelope blanks. Separating rolls are provided and rotate at a peripheral speed greater than the linear speed of the strip and are positioned downstream of the cutoff knife to separate and space the blanks from each other. Retractable rotator trimmer knives are positioned downstream from the separating rolls to trim the pointed ends from a diagonal blank. The rotatable trimmer knives are retracted into an inoperative position when forming rectangular envelope blanks. Seal flap cutters are positioned downstream of the trimmer knives and are arranged to remove portions of the envelope blank and form seal flaps on booklet type envelope blanks and seal flap corners on diagonal blanks. First bottom flap cutters are positioned downstream of the seal flap cutters. The first bottom flap cutters are arranged to remove portions of the envelope blank and form a portion of the bottom flap on both the booklet envelope blank and the diagonal envelope blank. A rotatable second bottom flap cutter is positioned downstream of the first bottom flap cutter. The second bottom flap cutter is arranged to remove other portions of the booklet envelope blank and form a bottom flap on the booklet envelope blank. The rotatable second bottom flap cutters are arranged to remove portions of the diagonal envelope blanks and trim the bottom seal flap edge of the diagonal envelope blank.

The invention further includes a method of forming either a generally rectangular booklet envelope blank or a generally diagonal envelope blank from a web on the same envelope blank forming machine and includes feeding the strip from a web into a pair of pull rolls on the envelope blank forming machine. The pull rolls are positioned perpendicular to the axis of the machine and the strip to form booklet envelope blanks. The pull rolls are positioned at an angular position to the axis of the machine to form diagonal envelope blanks. A pair of removable turnbars are positioned upstream from the pull rolls to change the direction of the strip from a direction aligned with the axis of the machine to a direction at an angle to the axis of the machine when forming diagonal envelope blanks on the machine. The turnbars are removed from the machine when forming booklet envelope blanks so that the strip is fed into the machine along the axis of the machine. A cutoff station is provided downstream of the pull rolls and includes a rotary cutoff knife that is arranged perpendicular to the axis of the strip and cuts the strip to form a blank that has a generally rectangular configuration. The rotary knife is adjusted so that the knife cuts the strip at an angle and forms a blank having a generally diagonal configuration. A separating and spacing station is provided when the envelope blanks cut from the strip are conveyed at a speed greater than the linear speed of the strip. A trim station is provided which includes rotatable trimmer knives to trim the pointed edges from the diagonal envelope blanks. The trimmer knives are retracted when booklet envelope blanks are being formed. The envelope blanks are then conveyed from the trim station to a seal flap forming station. Portions of the envelope blank are removed in the seal flap forming station to form seal flaps on rectangular booklet envelope blanks and seal flap corners on diagonal envelope blanks. The envelope blanks are conveyed from the seal flap forming station to a first bottom flap forming station where portions of the envelope blank are removed in the first forming station to form a portion of the bottom flap of a booklet envelope blank and forming a corner on the bottom flap of a diagonal envelope blank. The envelope blanks are then conveyed from the first bottom flap forming station to a second bottom flap forming station where portions of the envelope blank are removed and form a bottom flap on a booklet envelope blank and trim a portion of the diagonal envelope blank.

It will be apparent with the above invention that it is now possible to quickly and simply convert one envelope blank forming machine to another so that either generally rectangular envelope blanks or generally diagonal envelope blanks may be formed from a web by the same machine.

It is an object of this invention to provide an envelope blank forming machine where different types of envelope blanks may be formed.

Another object of this invention is to provide an envelope blank forming machine where components are interchangeable for use in forming two different types of envelope These and other objects of the present invention will be more completely disclosed and described in the following specification, the accompanying drawings and the appended claims.

DESCRIPTION OF THE PREFERRED EMBODIMENTS

Figures 1, 2, 3, 4:
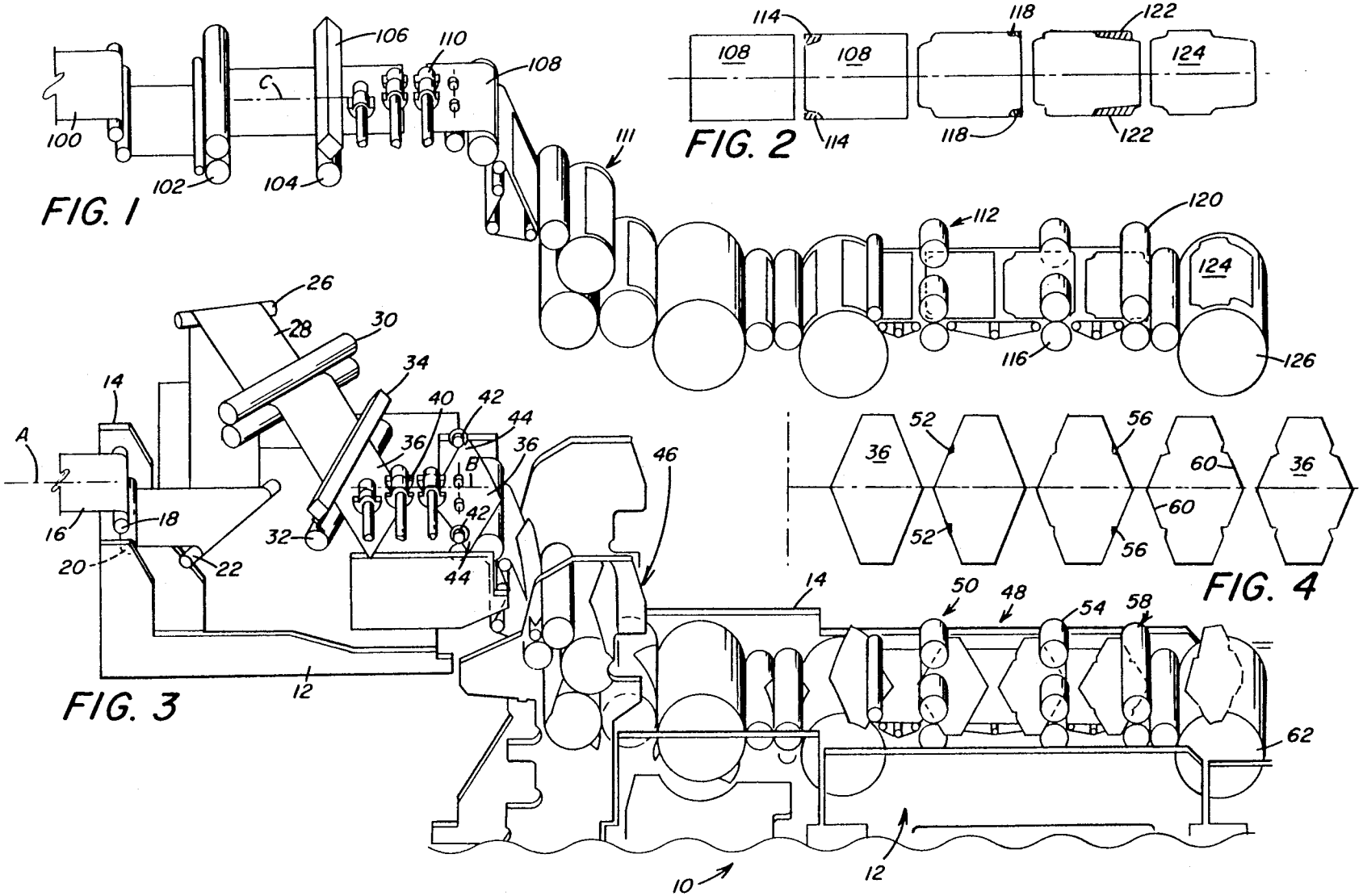
FIG. 1 is a diagrammatic representation of an envelope blank forming machine arranged to form generally rectangular booklet envelope blanks.
FIG. 2 is a diagrammatic representation of the sequential shapes of the booklet type envelope blank while it is being formed in the blank forming machine.
FIG. 3 is a diagrammatic view of the same envelope blank forming machine modified to form generally diagonal envelope blanks.
FIG. 4 is a view similar to FIG. 2 of the sequential shapes of the diagonal envelope blank as it is formed in the envelope blank forming machine illustrated in FIG. 3.

Referring to FIG. 3, the envelope blank forming machine is generally designated by the numeral 10 and the various components are diagrammatically illustrated. The envelope blank forming machine in FIG. 3 is arranged to form generally diagonal envelope blanks and is illustrated as having a first side frame 12 and a second side frame 14. The side frames 12 and 14 are segmented and are arranged to rotatably support the respective, hereinafter described, components and suitable gearing (not shown) is arranged to rotate the components in timed relation to each other.

A web of paper (not shown) has a strip 16 unwound therefrom and is fed into the machine 10. The strip passes between rolls 18 and 20 rotatably journaled in the frame side walls 12 and 14. A first turn bar 22 is rotatably supported by the frame members 12 and 14 at an angle to the axis A of the strip 16 and the strip 16 passes around the angularly positioned turnbar and moves around the turnbar 22 as designated by the numeral 24. Because of the angular position of the turnbars 22 and 26, the axis of the strip is angularly displaced from axis A of the strip 16 entering the machine 10. The turnbars 22 and 26 may be displaced horizontally or vertically The turnbars 22 and 26 are displaced generally horizontally. The web strip section 24 extends around a second turnbar 26 which directs the strip of material at an angle to the longitudinal axis of the machine 10 that is parallel to the frame sections 12 and 14. The angularly extending section 28 of the strip passes between a pair of pull rolls 30 which frictionally engage the angularly extending portion of strip 28 to pull the strip from the web and feed the strip to the envelope blank forming machine 10.

A rotatable cutoff roll 32 is positioned down stream of the pull roll 30 and is arranged to cut preselected lengths of paper from the strip 16. The cutoff knife 32 has a suitable backing member 34 such as an anvil to facilitate a sharp cut in the strip portion 28. The pull rolls, turnbars and cutoff mechanisms are conventional and well known in the art.

Because of the angular relation between the rotary cutoff knife 32 and the axis of the strip 16, the strip is cut diagonally to form a diamond shaped blank 36. The front and rear edges of the diamond shaped blank are formed from the body of the strip while the side edges of the diamond shaped blank 36 are formed from the existing side edges of the strip. A plurality of pull away conveying rolls 40 are arranged to separate the diamond shaped blanks and convey the blanks 36 in spaced relation along the axis of the envelope blank forming machine indicated by the --.-- line and identified by the letter B.

Rotatable edge trimmer knives 42 are rotatably journaled in the frames 12 and 14 and are arranged upon rotation to trim the pointed edges 44 from the diamond shaped blank 36. The configuration of trimmed diamond shaped blank is illustrated in FIG. 4 on the extreme left which is the first diagrammatic representation of the diagonal envelope blank as it is formed in the forming machine 10.

The generally diagonally shaped envelope blank is then conveyed by suitable rolls through a printer feeder portion of the machine generally designated by the numeral 46. It should be noted that the previously described portion of the envelope blank forming machine is positioned at a higher elevation than the printer feeder 46 so that the partially formed envelope blanks may be introduced into the upper portion of the printer feeder and conveyed therethrough.

The partially formed generally diagonal envelope blank 36 with the edges 44 trimmed by the trimming knives 42 is then introduced into the blank forming section 48 from the printer feeder 46. The blank 36 is conveyed by means of suitable rolls into a seal flap corner cutter device 50 that includes a pair of cutter rolls which cut and remove the shaded portion 52 illustrated in FIG. 4. After the seal flap corners 52 are removed from the blank 36, the blank is conveyed to a bottom flap corner cutter 54 which has a pair of rotating cutter devices arranged to remove the shaded section 56 illustrated in FIG. 4. With this arrangement, the seal flap corners are removed at the station generally designated by the numeral 50 and the bottom flap corners are removed at the station generally designated by the numeral 54.

The blank 36 with the seal flap and bottom flap corners formed therein is then conveyed to a trimming station 58 where the sharp edges indicated by the numeral 60 are trimmed from the blank 36 to form rounded edges as illustrated in the blank 36 at the extreme right end of FIG. 4 and illustrated on the transfer drum 62. The generally diagonal envelope blank is then fed into the envelope making machine where the blank is folded and suitable adhesive applied thereto.

Referring to FIGS. 1 and 2, the envelope blank forming machine generally designated by the numeral 10 is modified to form generally rectangular envelope blanks by removing certain of the essential components required for the generally diagonal envelope and substituting various other cutters for the seal flaps and bottom flaps of the generally rectangular booklet envelope blank.

Referring to FIGS. 1 and 2, a strip of paper 100 is unwound from a web (not shown) by a pair of pull rolls 102 which have the strip extending therebetween. The pull rolls 102 frictionally engage and exert a tension on the strip 100. The axis of the strip 100 is generally designated by the --.-- line designated by the letter C and it should be noted that the strip and the blanks severed thereform remain on the same axis C which is the same as the axis of the envelope blank forming machine. There are no angular or lateral deviations from this axis during the formation of the generally rectangular booklet type envelope blank. The rotatable cutoff knife 104 and the backing anvil 106 are the same as the cutoff knives 32 and 34, previously described. However, in the booklet embodiment illustrated in FIG. 1, the knive 104 and anvil 106 at the cutoff station are perpendicular to the axis C of the strip 100. The knive 104 severed rectangular segments 108 from the strip 100. Pull away or separator rolls 110, which are the same as previously described rolls 40, are arranged to separate the severed segments 108. The segments 108 have a generally rectangular configuration as illustrated in the left end segment 108 illustrated in FIG. 2. The segments 108 are conveyed through the printer feeder mechanism generally designated by the numeral 111 and diagrammatically illustrated by a plurality of rolls. The printer feeder mechanism 111 is the same as the printing mechanism 46 illustrated in FIG. 3.

The blank 108 is conveyed from the printer feeder 111 by means of rolls to the seal flap cutter generally designated by the numeral 112. The seal flap cutters 112 are arranged to cut the edges 114 illustrated as shaded areas in FIG. 2 from the rectangular blank 108 and form a seal flap on the envelope blank 108. The frame structure of the envelope blank forming machine is such that the seal flap cutters 112 may be easily changed from that for a booklet type of envelope blank to a diagonal type of envelope blank.

The blank 108 is then conveyed to bottom flap first cutter rolls generally designated by the numeral 116 which cuts the portions 118 in the blank 108 as illustrated in FIG. 2. The envelope blank 108 is then conveyed to bottom flap final cutter rolls generally designated by the numeral 120 which cut and remove the shaded portions 122 illustrated in FIG. 2. Thus a generally rectangular booklet envelope blank 124, illustrated in FIG. 1, on the transfer drum 126 in the envelope blank forming machine and on the right end of FIG. 2 is formed.

It should be understood that the envelope blank forming machine may be quickly converted from a machine that forms generally rectangular booklet envelope blanks to a machine that forms generally diagonal envelope blanks. For the booklet type envelope blanks, the turnbars 22 and 26 are removed and the feeder rolls 102 and cutoff knive 104 and anvil 106 are positioned perpendicular to the axis of the strip to form generally rectangular envelope blanks 108. The generally rectangular envelope blanks are then conveyed to a seal flap cutter station where suitable roller type seal flap cutters 112 are positioned in the machine to cut segments 114 from the envelope blank and form the seal flap. The blank is thereafter conveyed to a first bottom flap cutter station where suitable cutters 116 cut the portions 118 in the envelope blank and finally the envelope blank is conveyed to the final bottom flap cutter where the rolls 120 cut the portions 122 of the blank to form a bottom flap.

To convert the booklet machine to a diagonal machine, the turnbars 22 and 26 are positioned in the machine and the pull rolls and cutoff knives are positioned angularly to the axis of the strip. It should be noted that the knives 32 and 34 at the cutoff station may be adjusted to adjust the diagonal angle on the envelope blank. Trimmers, which are retracted when booklet envelope blanks are formed, are extended to cut off the corner edges of the generally diagonal envelope blank. The cutters for the seal flap and bottom flap are changed from those utilized with the booklet to remove the sections 56 illustrated in FIG. 4. Finally the booklet bottom flap cutter is removed and diagonal trim cutters are substituted therefor.

It will be apparent from the above arrangement that it is now possible to rapidly convert an envelope blank forming machine from a machine that makes generally rectangular booklet envelope blanks to a machine that makes generally diagonal envelope blanks.

According to the provisions of the Patent Statutes, we have explained the principal, preferred construction and mode of operation of our invention and have illustrated and described what we now consider to represent its best embodiments. However, it should be understood that, within the scope of the appended claims, the invention may be practiced otherwise than as specifically illustrated and described herein.

We claim:

1. An envelope blank forming machine to form either generally rectangular booklet envelope blanks or generally diagonal envelope blanks from a web comprising, pull rolls including means to pull the strip of paper from the web and feed the strip into the blank forming machine, said pull rolls positioned in a perpendicular position relative to the axis of the machine to feed the strip axially into the machine when forming booklet envelope blanks, means to move said pull rolls to an angular position relative to the axis of the machine to feed the strip at an angle to the axis of the machine for forming diagonal blanks, a rotatable cutoff knife positioned in a perpendicular position relative to the axis of the machine and perpendicular to the strip to cut booklet envelope blanks from the strip having a generally rectangular configuration, means to move said rotatable cutoff knife to an angular position relative to the axis of the machine and the strip to cut the strip diagonally to the strip axis to form a blank having a diagonal configuration, a first removable turnbar positioned upstream of said pull rolls, said first turnbar arranged at an angle to the axis of the blank forming machine, said turnbar including means to angularly change the direction of the strip from a direction aligned with the axis of the machine to an angular direction, said first turnbar being removed from the machine during the forming of booklet envelope blanks, a second removable turnbar positioned in spaced relation to said first turnbar and arranged at an angle to the axis of the blank forming machine, said second turnbar including means to control the direction of movement of the strip to said pull rolls so that said strip moves at an angle to the axis of the machine, said second turnbar being removed from the machine during the forming of booklet envelope blanks, separating rolls rotating at a peripheral speed greater than the linear speed of said strip positioned downstream of said cutoff knife to separate and space said blanks from each other, retractable, rotatable trimmer knives positioned downstream from said separating rolls to trim the pointed ends from a diagonal blank, retracting said rotatable trimmer knives into an inoperative position when forming rectangular envelope blanks, seal flap cutters positioned downstream of said trimmer knives, said seal flap cutters including means to remove portions of said envelope blank and form seal flaps on booklet envelope blanks and seal flap corners on diagonal blanks, first bottom flap cutters positioned downstream of said seal flap cutters, said first bottom flap cutters including means to remove portions of said envelope blank and form a portion of the bottom flap on both the booklet envelope blank and the diagonal envelope blank, and rotatable second bottom flap cutters positioned downstream of said first bottom flap cutters, said second bottom flap cutters including means to remove other portions of said booklet envelope blank and form a bottom flap on said booklet envelope blank, said rotatable second bottom flap cutters also including means to remove portions of the diagonal envelope blanks and trim the bottom seal flap edge of the diagonal envelope blank.

2. A method of forming either a generally rectangular booklet envelope blank or a generally diagonal envelope blank from a web on the same envelope blank forming machine comprising, feeding a strip from a web into a pair of pull rolls on the envelope blank forming machine, positioning the pull rolls perpendicular to the axis of the machine and the strip to form booklet envelope blanks and positioning the pull rolls at an angular position to the axis of the machine to form diagonal envelope blanks, positioning a pair of removable turnbars upstream from said pull rolls to change the direction of said strip from a direction aligned with the axis of the machine to a direction at an angle to the axis of the machine when forming diagonal envelope blanks on the machine, removing the turnbars from the machine when forming booklet envelope blanks so that the strip is fed into the machine along the axis of the machine, providing a cutoff station downstream of the pull rolls, said cutoff station including a rotary cutoff knife that is arranged perpendicular to the axis of the strip and cuts the strip to form a blank that has a generally rectangular configuration, adjusting said rotary knife so that said knife cuts the strip at an angle and forms a blank having a generally diagonal configuration, providing a separating and spacing station where the envelope blanks cut from the strip are conveyed at a speed greater than the linear speed of the strip, providing a trim station which includes rotatable trimmer knives to trim the pointed edges from the diagonal envelope blanks and retracting the trimmer knives when forming rectangular booklet envelope blanks, conveying the envelope blanks from the trim station to a seal flap forming station, removing portions of the envelope blank in the seal flap forming station to form seal flaps on rectangular booklet envelope blanks and seal flap corners on diagonal envelope blanks, conveying the envelope blanks from the seal flap forming station to a first bottom flap forming station, removing portions of the envelope blank in the first bottom flap forming station to remove a portion of the blank and form a portion of the bottom flap of a booklet envelope blank and forming a corner on the bottom flap of a diagonal envelope blank, conveying the envelope blanks from the first bottom flap forming station to a second bottom flap forming station, and removing portions of the envelope blank in the second bottom flap forming station to remove other portions of the blank and form a bottom flap of a booklet envelope blank and trim a portion of the diagonal envelope blank.

* * * * *